US005397487A

United States Patent [19]

Pillon et al.

[11] Patent Number: 5,397,487

[45] Date of Patent: Mar. 14, 1995

[54] LUBRICATING OIL FOR INHIBITING RUST FORMATION

[75] Inventors: Lilianna Z. Pillon; Lloyd E. Reid, both of Sarnia; Andre E. Asselin, Forest, all of Canada

[73] Assignee: Exxon Research & Engineering Co., Florham Park, N.J.

[21] Appl. No.: 112,167

[22] Filed: Aug. 26, 1993

Related U.S. Application Data

[63] Continuation-in-part of Ser. No. 809,906, Dec. 18, 1991, abandoned.

[51] Int. Cl.[6] ..... C10M 141/06

[52] U.S. Cl. ..... 252/51.5 R; 252/56 S; 252/56 D

[58] Field of Search ..... 252/56 S, 56 R, 56 D, 252/51.5 R

[56] References Cited

U.S. PATENT DOCUMENTS

| | | | |
|---|---|---|---|
| 3,901,932 | 8/1975 | Tada et al. | 260/455 P |
| 4,263,155 | 4/1981 | Frost | 252/49.8 |
| 4,687,590 | 8/1987 | Haack | 252/75 |
| 4,892,671 | 1/1990 | O'Neil et al. | 252/51.5 R |

*Primary Examiner*—Margaret Medley

*Attorney, Agent, or Firm*—John W. Ditsler; James H. Takemoto

[57] ABSTRACT

A combination of succinic anhydride amine derivatives and tetra propenyl succinic acid derivative rust inhibitors has been found to be synergistically effective in reducing the formation of rust in lubricating oils.

3 Claims, No Drawings

LUBRICATING OIL FOR INHIBITING RUST FORMATION

This application is a continuation-in-part of U.S. application Ser. No. 809,906, filed on Dec. 18, 1991, abandoned.

BACKGROUND OF THE INVENTION

1. Field of the Invention

This invention concerns the use of a synergistic combination of two rust inhibitors to inhibit rust formation in lubricating oils.

2. Description of Related Art

Many lubricating oils require the presence of rust inhibitors to inhibit or prevent rust formation, which often occurs due to water contacting a metal surface. However, we have found that a synergistic combination of rust inhibitors is particularly effective in preventing rust in lubricating oils.

SUMMARY OF THE INVENTION

In one embodiment, this invention concerns a lubricating oil capable of inhibiting rust formation which comprises a major amount of a lubricating oil basestock and a minor synergistic rust inhibiting amount of an additive combination comprising:

(a) a succinic anhydride amine derivative of the formula

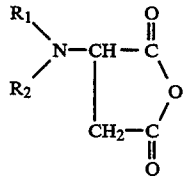

(I)

wherein $R_1$ and $R_2$ are each independently alkyl or alkenyl of from 1 to 20 carbon atoms, and (b) tetrapropenyl succinic acid, partially esterified tetrapropenyl succcinic acid and mixtures thereof;

wherein the weight ratio of (b) to (a) is greater than zero and less than about 1:1.

In another embodiment, this invention concerns a method for inhibiting rust formation in an internal combustion engine by lubricating the engine with the oil described above.

DETAILED DESCRIPTION OF THE INVENTION

This invention requires a major amount of a lubricating oil basestock and a minor synergistic rust inhibiting amount of a combination of two oil soluble rust inhibitors.

The lubricating oil basestock can be derived from natural lubricating oils, synthetic lubricating oils, or mixtures thereof. Suitable lubricating oil basestocks also include basestocks obtained by isomerization of synthetic wax and slack wax, as well as hydrocrackate basestocks produced by hydrocracking (rather than solvent extracting) the aromatic and polar components of the crude. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di (2-ethylhexyl)benzene, etc.); polyphenyls (e.g. biphenyls, terphenyls, alkylated polyphenyls, etc. ); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc. ). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerylthritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2ethylhexyl) silicate, tetra-(4-methyl-2-ethylhexyl) silicate, tetra(p-tert-butyphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

One of the oil soluble rust inhibitors used in this invention (inhibitor a) must be capable of reducing the interfacial tension between the oil and water in the oil to from about 1 to about 4, preferably to from about 1.5 to about 2.5, mN/m, as measured by ASTM Test Method D971-82. In the formula for inhibitor (a), $R_1$ and $R_2$ are $C_1$ to $C_{16}$ alkyl or alkenyl which may be linear or branched and may be substituted with hydroxy, amino and the like.

The other oil soluble rust inhibitor (inhibitor b) preferably is a mixture of tetrapropenyl succinic acid and partially esterified tetrapropenyl succinic acid. The mixture preferably contains at least 70 wt. % of tetrapropenyl succinic acid and less than 30 wt. % of a partially esterified tetrapropenyl succinic acid. The partially esterified tetrapropenyl succinic acid is preferably a monoester of tetrapropenyl succinic acid. In the monoester moiety, —$COOR_3$, $R_3$ is preferably a $C_1$ to $C_4$ hydrocarbyl. An especially preferred $R_3$ is a $C_3$ hydrocarbyl radical substituted with hydroxy.

The amount of the additive combination added need only be an amount that is necessary to impart rust inhibition performance to the oil; i.e. a rust inhibiting amount. Broadly speaking, this corresponds to using at least about 0.03 wt. % based on oil of the combination. However, the minimum amount required will vary with the particular feedstock. For example, high viscosity basestocks such as 1400 Neutral or higher base oils will require at least 0.1 wt. % or more, while most other lower viscosity basestocks (such as 150 to 600 Neutral) require at least 0.03–0.04 wt. % based on oil. Although not necessary, an amount of the combination in excess of the minimum amount required could be used if desired, for example, from 0.03 to 10 wt. % based on oil.

The relative amount of the two inhibitors used is important. To pass the ASTM D665B rust test, the weight ratio of inhibitor (b) to inhibitor (a) should be greater than zero and less than 1:1.

As shown in the following examples, rust inhibitors suitable for use in this invention are commercially available. As such, so is their method of preparation.

If desired, other additives known in the art may be added to the lubricating base oil. Such additives include dispersants, anti-wear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

A lubricating oil containing the synergistic rust inhibitor combination described above can be used in essentially any application where rust inhibition is required. Thus, as used herein, "lubricating oil" (or "lubricating oil composition") is meant to include automotive crankcase lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples, which include a preferred embodiment of the invention. In the examples, the rust protection was measured using ASTM Test Method D665B, the disclosure of which is incorporated herein by reference.

EXAMPLE 1

Properties of Base Oils Tested

The properties of the nine base oils tested in the following examples are shown in Table 1.

TABLE 1

| Base Oils | A(1) | B(2) | C(3) | D(4) | E(5) | F(6) | G(7) | H(8) | I(9) |
|---|---|---|---|---|---|---|---|---|---|
| Viscosity, cSt | | | | | | | | | |
| @ 40° C. | 30.4 | 29.4 | 32.7 | 29.7 | 29.5 | 30.0 | 111.4 | 105.9 | 301.7 |
| @ 100° C. | 5.8 | 5.8 | 5.6 | 5.1 | 5 | 5.3 | 11.6 | 11.3 | 22 |
| Viscosity Index | 134 | 143 | 106 | 96 | 94 | 107 | 89 | 92 | 89 |
| Hydrocarbon Analysis, wt % | | | | | | | | | |
| Saturates | >99.5 | >99.5 | >99.5 | 86.1 | 82.8 | 71.6 | 80.4 | 80.5 | 68.3 |
| Aromatics/Polars | <0.5 | <0.5 | <0.5 | 13.9 | 17.2 | 28.4 | 19.6 | 19.5 | 31.7 |
| Nitrogen, ppm | | | | | | | | | |
| Total | <1 | 1 | <1 | 36 | 8 | 24 | 100 | 30 | 141 |
| Basic | 0 | 0 | 0 | 33 | 4 | 23 | 88 | 16 | 51 |
| Sulfur, ppm/wt % | <1 | <1 | <1 | 0.06 | 0.09 | 0.49 | 0.11 | 0.12 | 0.18 |
| Distillation, °C. | | | | | | | | | |
| Initial BP | 408 | 341 | 340 | 324 | 334 | 319 | 370 | 362 | 404 |
| Mid BP | 481 | 465 | 433 | 418 | 418 | 431 | 488 | 488 | 543 |

TABLE 1-continued

| Base Oils | A(1) | B(2) | C(3) | D(4) | E(5) | F(6) | G(7) | H(8) | I(9) |
|---|---|---|---|---|---|---|---|---|---|
| Final BP | 596 | 570 | 533 | 526 | 513 | 559 | 587 | 598 | 637 |

(1)A polyalphaolefin synthetic base oil obtained by polymerizing a $C_{10}$ monomer to form a mixture of three components: $C_{10}$ trimer ($C_{30}$), $C_{10}$ tetramer ($C_4$), and $C_{10}$ pentamer ($C_{50}$).
(2)A slack wax isomerate, which is the lubes fraction remaining following dewaxing the isomerate formed from isomerizing slack wax.
(3)A white oil obtained by high pressure hydrogenation to saturate aromatics and remove essentially and sulfur and nitrogen from conventional base oils.
(4)A conventional 150 Neutral NMP extracted base oil which is then solvent dewaxed and hydrofinished.
(5)A conventional 150 Neutral phenol extracted base oil which is then solvent dewaxed and hydrofinished.
(6)A conventional 150 Neutral NMP extracted base oil which is then solvent dewaxed and hydrofinished.
(7)A conventional 600 Neutral NMP extracted base oil which is then solvent dewaxed and hydrofinished.
(8)A conventional 600 Neutral phenol extracted base oil which is then solvent dewaxed and hydrofinished.
(9)A conventional 1400 Neutral phenol extracted base oil which is then solvent dewaxed and hydrofinished.

EXAMPLE 2

Rust Protection of Various Base Oils Using Lz 859

Rust protection tests were performed on the base oils of Example 1 containing various concentrations of Lz 859, commercial rust inhibitor available from The Lubrizol Corporation. This inhibitor is a mixture of about 74.5 wt. % unreacted tetrapropenyl succinic acid of the formula

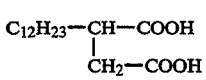

(1)

and about 25.5 wt. % of a partially esterified tetrapropenyl succinic acid of the formula

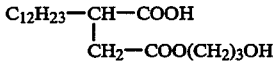

(2)

which is obtained by reacting (1) with $HO-(CH_2)_3-OH$. The results of these tests are shown in Table 2 below.

TABLE 2

| Base Oils | Rust Test Results at Various Wt. % Lz 859 | | | |
|---|---|---|---|---|
| | 0.03 | 0.05 | 0.10 | 0.15 |
| A | Fail | Fail | Fail | Fail |
| B | Fail | Fail | Fail | Fail |
| C | Fail | Fail | Pass | Pass |
| D | Pass | Pass | Pass | Pass |
| E | Fail | Pass | Pass | Pass |
| F | Fail | Pass | Pass | Pass |
| G | Pass | Pass | Pass | Pass |
| H | Fail | Pass | Pass | Pass |
| I | Fail | Fail | Fail | Fail |

The data in Table 2 show that only base oils D and G pass the rust test using 0.03 wt. % of Lz 859. At a concentration of 0.05 wt. %, base oils D–H (i.e. conventional base oils—those containing less than about 95% wt. % saturates) passed the test. Only base oils A–C (i.e. non-conventional base oils—those containing at least about 95 wt. % saturates) and base oil I (a high viscosity conventional base oil) failed the rust test. However, base oil C passed when the concentration of Lz 859 was increased to 0.1 wt. %. Oils A, B, and I still did not pass at concentrations up to 0.15 wt. %.

EXAMPLE 3

Rust Protection of Various Base Oils Using Mobilad C603

Rust protection tests were performed on the base oils of Example 1 containing various concentrations of Mobilad C603, a commercial rust inhibitor available from Mobil Chemical Company. This inhibitor is a succinic anhydride amine solution that can reduce the interfacial tension between oil and water in the oil to from about 1 to about 4, preferably to from about 1.5 to about 2.5, mN/m, as measured by ASTM Test Method D971-82, the disclosure of which is incorporated herein by reference. The results of these tests are shown in Table 3 below.

TABLE 3

| Base Oils | Rust Test Results at Various Wt. % Mobiled C603 | | | |
|---|---|---|---|---|
| | 0.03 | 0.05 | 0.1 | 0.15 |
| A | Fail | Fail | Pass | Pass |
| B | Fail | Fail | Pass | Pass |
| C | Fail | Fail | Fail | Pass |
| D | Fail | Fail | Pass | Pass |
| E | Fail | Fail | Pass | Pass |
| F | Fail | Fail | Fail | Pass |
| G | Fail | Fail | Pass | Pass |
| H | Fail | Fail | Pass | Pass |
| I | Fail | Fail | Fail | Pass |

The data in Table 3 show that Mobilad C603 can prevent rust formation in all of the base oils tested, but at significantly increased concentrations relative to the amounts required using Lz 859. For example, as shown in Table 2, Lz 859 can prevent rust formation in oils D–H at a concentration from 0.03–0.05 wt. %, but was ineffective in oils A, B, and I at higher concentrations.

EXAMPLE 4

Synergism Between Mobilad C603 and Lz 859 Prevents Rust

Mobilad C603 and Lz 859 were blended in a 1:1 weight ratio to determine the minimum concentration required to pass the rust test using several base oils described in Example 1. The results of these tests are shown in Table 4 below.

TABLE 4

| Base Oils | Concentration of Ratio Lz 859/Mobilad C603 | | | |
|---|---|---|---|---|
| | 0.03 | 0.04 | 0.05 | 0.1 |
| A | Pass | (1) | Pass | (1) |
| B | Pass | (1) | Pass | (1) |
| C | Fail(2) | Pass | Pass | (1) |
| E | Pass | (1) | (1) | (1) |
| H | Pass | (1) | (1) | (1) |
| I | (3) | (3) | Fail | Pass |

(1)Not tested because lower concentration passed.
(2)Borderline failure.
(3)Not tested because failed at a higher concentration.

The data in Tables 2–4 show that a synergism between the two rust inhibitors allows obtaining rust protection at a lower concentration of the mixture than can be obtained at higher concentration of each inhibitor alone. For example, oils E and H require 0.05 wt. % of Lz 859 (see Table 2) to pass the rust test, but only 0.03 wt. % to pass using a blend of Lz 859 and Mobilad C603 in a 1:1 weight ratio. Similarly, oils A–C normally require from 0.1 to 0.15 wt. % Mobilad C603 to pass, but did so using 0.03–0.05 wt. % of the blend.

EXAMPLE 5

Weight Ratio of Lz 859 to Mobilad C603 Important

The rust performance of different weight ratios of Lz 859 and Mobilad C603 in Oil B were determined at the same total concentration (0.03 wt. %). The results of these tests are shown in Table 5 below.

TABLE 5

| Lz 859/Mobilad C603 Ratio, wt. % | Concentration wt. % | Rust Test Results |
|---|---|---|
| 100:0(1) | 0.03 | Fail |
| 95:5 | 0.03 | Fail |
| 90:10 | 0.03 | Fail |
| 80:20 | 0.03 | Fail |
| 70:30 | 0.03 | Fail |
| 60:40 | 0.03 | Pass/Borderline |
| 50:50 | 0.03 | Pass/Borderline |
| 40:60 | 0.03 | Pass |
| 30:70 | 0.03 | Pass |
| 20:80 | 0.03 | Pass |
| 10:90 | 0.03 | Pass |
| 0:100(2) | 0.03 | Fail |

(1)Failed at 0.15 wt. % Lz 859.

(2)Minimum of 0.06 wt. % required to pass.

The data in Table 5 show that the weight ratio of Lz 859 to Mobilad C603 must be greater than zero and less than 1:1 for effective rust performance.

What is claimed is:

1. A lubricating oil composition which comprises a major amount of a lubricating oil basestock selected from the group consisting of polyalphaolefin synthetic base oil and slack wax isomerate wherein the basestock contains at least about 95 wt. % of hydrocarbon saturates and a minor synergistic rust inhibiting amount of an additive combination comprising (a) a succinic anhydride amine of the formula

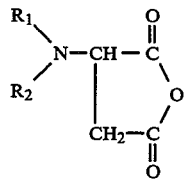

(I)

wherein $R_1$ and $R_2$ are each independently alkyl or alkenyl of 1 to 20 carbon atoms, and (b) a mixture of about 75 wt. % tetrapropenyl succinic acid and about 25 wt. % monoester of tetrapropenyl succinic acid with $HO(CH_2)_3OH$;

wherein the weight ratio of (b) to (a) is greater than zero and less than about 1:1.

2. The oil composition of claim 1 wherein the amount of components (a) and (b) is from about 0.03 wt % to about 10 wt % based on oil of the combination.

3. A method for inhibiting the formation of rust in an internal combustion engine which comprises lubricating the engine with the oil composition of claim 1.

* * * * *